US005247863A

United States Patent [19]

Cohen

[11] Patent Number: 5,247,863

[45] Date of Patent: Sep. 28, 1993

[54] ONE-PIECE PLASTIC HOLE PUNCHER

[76] Inventor: Yoav Cohen, 22 Szold St., Raanana, Israel

[21] Appl. No.: 821,169

[22] Filed: Jan. 16, 1992

[51] Int. Cl.[5] ..... B26F 1/02

[52] U.S. Cl. ..... 83/167; 83/520; 83/588; 83/620; 83/633; 83/699

[58] Field of Search ..... 83/167, 520, 588, 618, 83/620, 633, 684, 685, 686, 687, 690, 691, 699; 30/358, 363

[56] References Cited

U.S. PATENT DOCUMENTS

| | | | |
|---|---|---|---|
| 909,739 | 1/1909 | Barrett | 83/167 |
| 3,387,526 | 6/1968 | Neilsen | 83/588 X |
| 3,628,407 | 12/1971 | Adams | 83/520 X |
| 4,036,088 | 7/1977 | Ruskin | 83/167 |
| 4,656,907 | 4/1987 | Hymmen | 83/167 X |
| 4,757,733 | 7/1988 | Barlow | 83/588 |

FOREIGN PATENT DOCUMENTS

| | | | |
|---|---|---|---|
| 3339742 | 5/1985 | Fed. Rep. of Germany | 83/167 |

*Primary Examiner*—Frank T. Yost
*Assistant Examiner*—Raymond D. Woods
*Attorney, Agent, or Firm*—Edward Langer; David P. Gordon

[57] ABSTRACT

A hole puncher formed as one piece of plastic molded into base, handle and receptacle portions hinged together by flexible, foldable joints. The one-piece plastic construction can be assembled quickly as a hole puncher by folding the portions into predetermined positions. A feature of the hole puncher is the use of a plastic locking strap connecting the handle and the base, for maintaining the handle folded over the base. Another feature is the use of translucent plastic material, enabling the user to visually check the desired alignment of pins with the paper to be punched, to assure proper location of the punched holes. The design provides an attractive, affordable and easily assembled design without sacrificing strength and durability.

19 Claims, 3 Drawing Sheets

ONE-PIECE PLASTIC HOLE PUNCHER

FIELD OF THE INVENTION

The present invention relates to devices for punching holes in paper, and more particularly, to a one-piece plastic hole puncher manufactured as an inexpensive, foldable assembly.

BACKGROUND OF THE INVENTION

A common office acccessory is the manual hole puncher, which is typically of metal construction with hinged parts including a base, a handle and a set of metal cylindrical pins. The pins are arranged to be depressed by the handle so that they extend downward to punch holes in the paper and extend into holes formed in the base. The mechanical arrangement is simple yet expensive to manufacture and assemble, since it consists of various parts requiring precision manufacturing and assembly.

In many applications, the development of improved plastic engineering materials has allowed replacement of a metal structural component with a suitable plastic. The benefits to be derived from the use of plastic materials include reduced cost and manufacturing time, reduced weight and many other benefits.

Therefore, it would be desirable to provide a plastic hole puncher, which can be manufactured as a one-piece unit capable of easy assembly by folding various sections into place.

SUMMARY OF THE INVENTION

Accordingly, it is a principal object of the present invention to overcome the disadvantages associated with prior art hole puncher constructions and provide a one-piece plastic hole puncher designed for easy manufacture and assembly by folding sections into place. The hole puncher can be adapted to many designs based on the number of holes and page length required.

In accordance with a preferred embodiment of the present invention, there is provided a one-piece plastic hole puncher comprising:

a base having formed therein a horizontal guide slot and a guide hole for guiding a pin vertically over said guide slot;

a handle for depressing said pin in said guide hole so as to cut through material placed in said guide slot; and a receptacle disposed under said base for collecting said cut material, wherein said base, handle and receptacle are formed of one piece of plastic hinged together by flexible, foldable joints.

In the preferred embodiment, the inventive hole puncher comprises one piece of plastic molded into base, handle and receptacle portions hinged together by flexible, foldable joints. The one-piece plastic construction can be assembled quickly as a hole puncher by folding the portions into predetermined positions.

The handle and receptacle are each hinged to the base by a plastic strip integrally formed with each of these portions, forming the flexible joint, and allowing for quick and easy assembly. A set of pins is placed in the guide holes of the base, and the handle is then folded over the base. When the receptacle is folded under the base, the hole puncher is ready for service.

Depression of the handle over the pins forces them downward through the guide holes and through the paper placed in the guide slot, to complete the hole punch operation. The cut paper material is collected in the receptacle for disposal.

A feature of the invention is the use of a plastic locking strap connecting the handle and the base, for maintaining the handle folded over the base.

Based on its unique one-piece design, the inventive hole puncher can be manufactured inexpensively, making it an attractive, affordable and easy-to-assemble office accessory.

Other features and advantages of the invention will become apparent from the drawings and the description hereinbelow.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1:
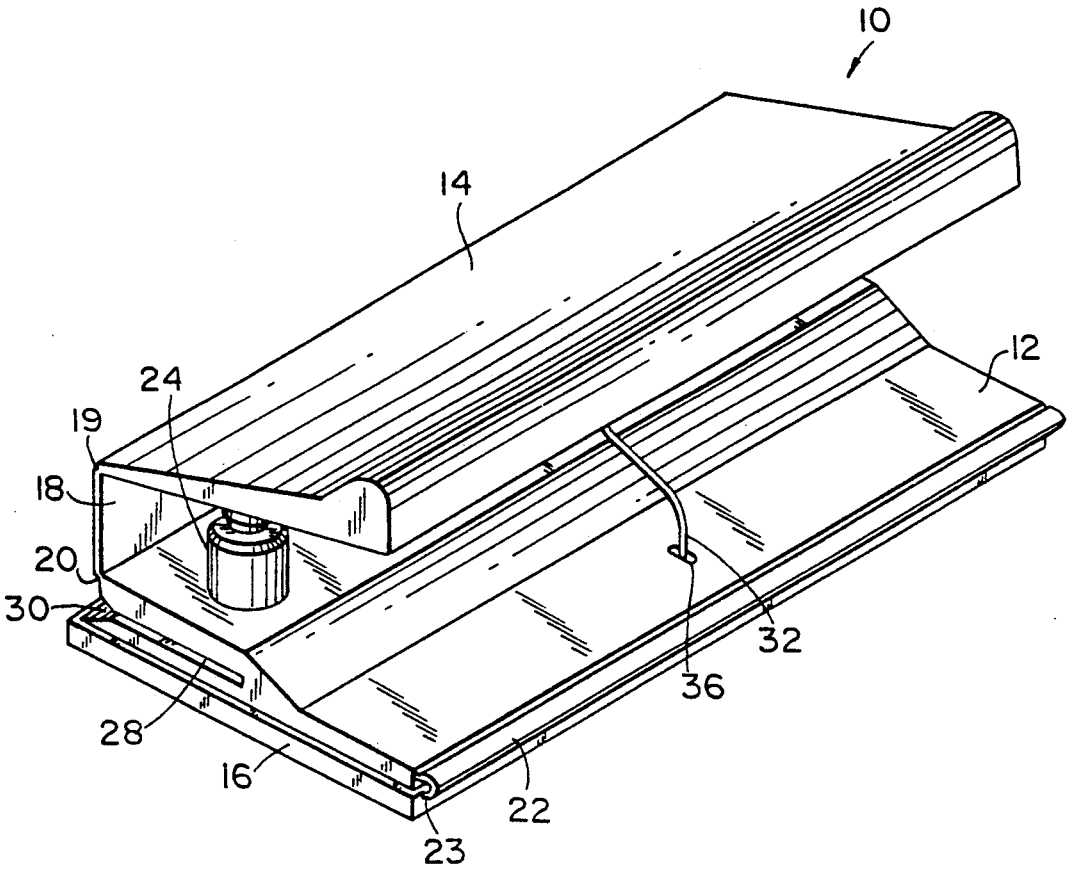
FIG. 1 is a perspective view of a one-piece plastic hole puncher constructed in accordance with the present invention.

Referring now to FIG. 1, there is shown a perspective view of a one-piece plastic hole puncher 10 constructed in accordance with the principles of the invention. Hole puncher 10 comprises a one-piece plastic material defining a base 12, a handle 14, and a receptacle 16 under the base 12 for collecting waste hole punchings for disposal. Base 12 and handle 14 are integrally formed with a plastic strip 18 defining a pair of flexible joints 19 and 20. Another plastic strip 22 forms a flexible joint 23 connecting base 12 and collection receptacle 16. Since it is connected, collection receptacle 16 is not easily lost.

Base 12 has formed therein a pair of guide posts 24 formed with holes 25 (FIGS. 2–3) each for seating one of a pair of punch pins 26, typically made of metal. Each of pins 26 is spring-loaded using a spring 27. A guide slot 28 formed in base 12 allows for insertion of paper for punching, via a slanted feed edge 30 for simplifying insertion. A plastic locking strap 32 is formed integrally with the underside of handle 14, and a free end thereof is formed with a cap 34 which is insertable in a hole 36 formed in base 12, to maintain handle 14 folded over base 12.

When depressed, handle 14 forces pins 26 downward in guide holes 25, such that they punch holes in paper inserted in slot 28. Springs 27 act on pins 26, pushing them upward to return handle 14 upward to its original position, as maintained by strip 18, flexible joints 19–20 and locking strap 32.

Figure 2:
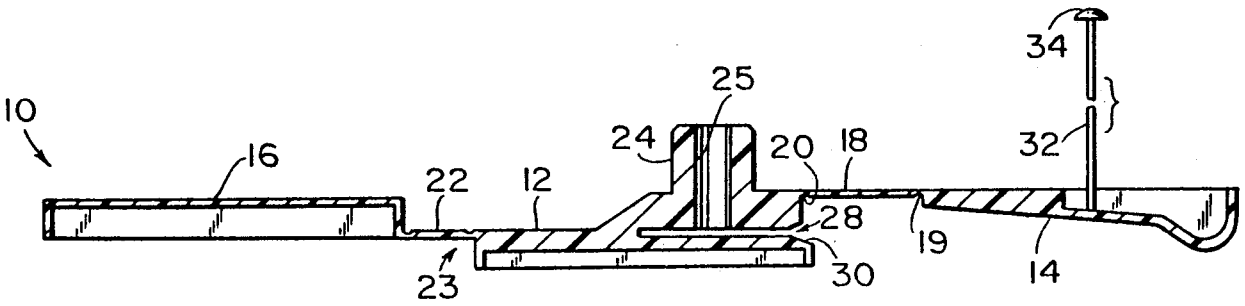
FIGS. 2–3 are, respectively, side cross-sectional views of the hole puncher shown before and after assembly.
Figure 3:
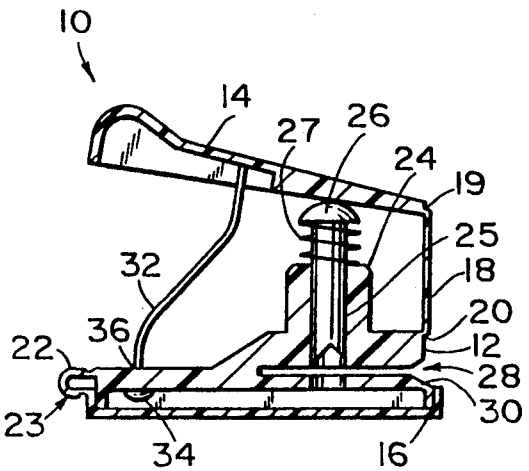

As shown in the cross-sectional views of FIGS. 2–3, hole puncher 10 is a one-piece construction, such that the flat layout in FIG. 2 is foldable at flexible joints 19–20 and 23 for assembly. Before folding as in FIG. 3, the pins 26 and springs 27 are inserted, and then locking strap 32 is inserted in hole 36. Collection receptacle 16 is folded at joint 23 over the underside of base 12, and can be likewise re-opened, to empty its contents.

Once folded, the inventive one-piece hole puncher is immediately ready for use, so that it may be provided as a flat layout and assembled with minimum difficulty by the user.

Figure 4:
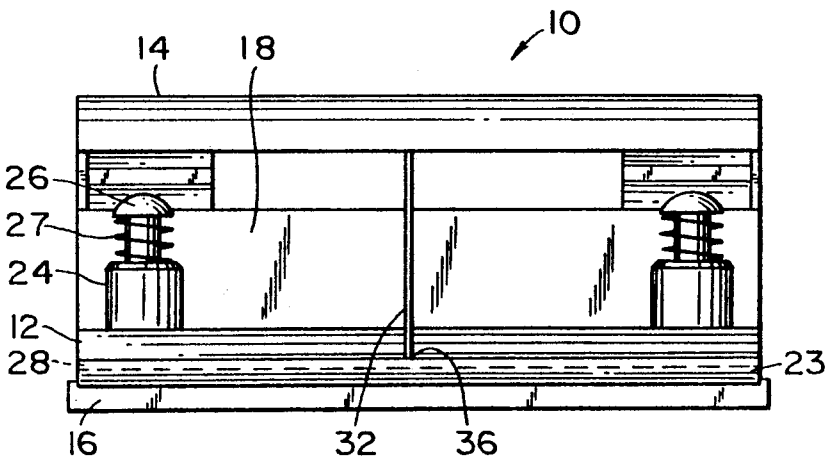
FIG. 4 is a front view of a two-hole version of the assembled hole puncher.
Figure 5:
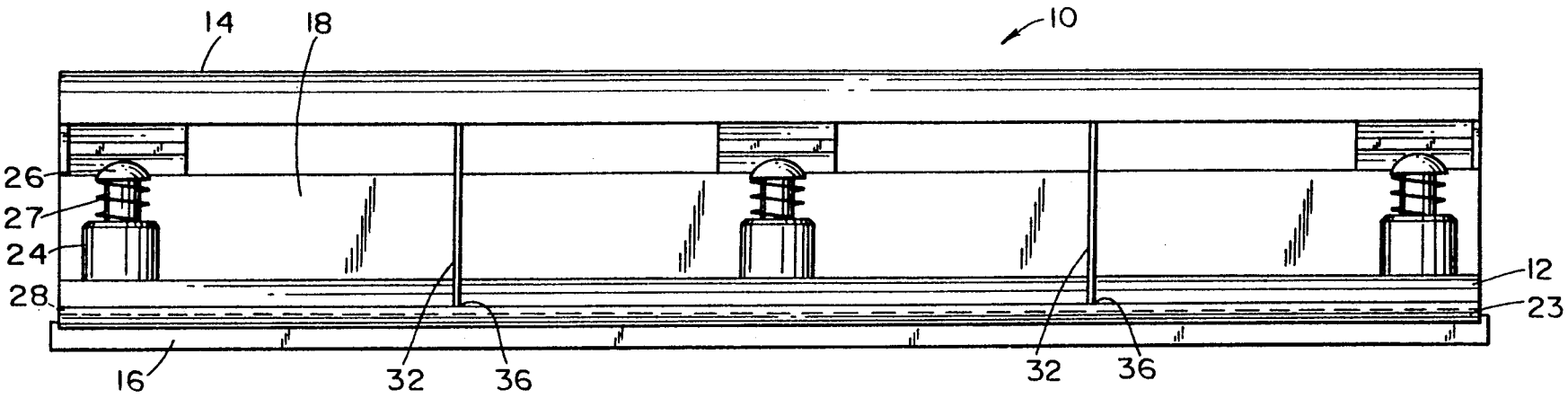
FIG. 5 is a front view of a three-hole version of the assembled hole puncher.

FIGS. 4 and 5 show front views of the inventive plastic hole puncher in two assembled versions, a two-hole version (FIG. 4) and a three-hole version (FIG. 5). As will be understood, the length of the hole puncher 10 and position of pins 26 may be designed in accordance with particular applications.

The advantages of the inventive design of one-piece plastic hole puncher 10 are many, including the fact that no welding or screws are required for assembly. In addition, because it is plastic, the manufacturing process is simplified, since an injection molding process may be used to produce a finished unit. No paint or chipping of the finish occurs with plastic parts, and the design is not susceptible to rust.

Also, manufacturing tolerances are controllable within acceptable limits, since unlike with prior art designs, no alignment of components is necessary in assembly. There are no weak points, and the flexibility of the plastic parts insures the ability to absorb stresses without breakage, by deformation. Thus, even where a punch operation is attempted and a high amount of force is required, sufficient "give" exists to avoid breakage.

Since strength is a factor in the inventive design, suitable plastic materials are used, such as polypropylene or nylon 6. The one-piece design creates an inherently strong unit.

The reduced cost of manufacturing associated with the inventive design constitutes a major advantage, since even if the metal punch pins are replaced once they become dull, the total cost of the unit is still less expensive than existing designs. As a result, the unit can be sold with replacement pins provided.

An additional feature of the inventive design is that translucent plastic material may be used, enabling the user to visually check the desired alignment of pins 26 with the paper to be punched, to assure proper location of the punched holes.

In summary, the inventive one-piece plastic hole puncher affords many advantages over existing metal constructions, in providing an attractive, affordable and easily assembled design without sacrificing strength and durability.

Having described the invention with regard to certain specific embodiments thereof, it is to be understood that the description is not meant as a limitation, since further modications may now suggest themselves to those skilled in the art, and it is intended to cover such modifications as fall within the scope of the appended claims.

I claim:

1. A hole puncher comprising:

a) a plastic base having formed therein a horizontal guide slot and a guide hole which guides a pin vertically over said guide slot;

b) a plastic handle for depressing said pin in said guide hole so as to cut through material placed in said guide slot; and c) a plastic connector strip between said plastic base and said plastic handle;

d) first and second plastic hinges, said first plastic hinge coupling said plastic connector strip to said plastic base, and said second plastic hinge coupling said plastic connector strip to said plastic handle, said first and second plastic hinges being flexible and foldable, and said plastic base, said plastic handle, and said plastic connector strip being relatively rigid relative to said first and second plastic hinges, wherein said plastic base, said plastic handle, said plastic connector strip, and said first and second plastic hinges are formed from one piece of plastic.

2. A hole puncher according to claim 1, further comprising:

e) a plastic receptacle means disposed under said plastic base for collecting pieces of said material cut through by said pin, wherein said plastic receptacle means is coupled to said plastic base by a flexible, foldable joint, and said plastic receptacle means and said flexible foldable joint are formed from said one piece of plastic.

3. A hole puncher according to claim 2, further comprising:

a plastic strap having a first end integrally formed with said plastic handle and a second end inserted into a hole formed in said plastic base, said plastic strap holding said plastic handle in a folded arrangement with said plastic base, and said plastic strap engaging said plastic base while said hole puncher is in use.

4. A hole puncher according to claim 1, further comprising:

a plastic strap having a first end integrally formed with said plastic handle and a second end inserted into a hole formed in said plastic base, said plastic strap holding said plastic handle in a folded arrangement with said plastic base, and said plastic strap engaging said plastic base while said hole puncher is in use.

5. A hole puncher according to claim 4, wherein:

an operative arrangement of said hole puncher comprises said plastic base, said plastic connector strip, and said plastic handle held in a substantially C-shaped configuration by said plastic strap.

6. A hole puncher according to claim 1, wherein:

an operative arrangement of said hole puncher comprises said plastic base, said plastic connector strip, and said plastic handle in a substantially C-shaped configuration.

7. A hole puncher according to claim 1, further comprising:

said pin which is guided by said guide hole, and a coil spring mounted on said pin and spring loading said pin into contact with said plastic handle, wherein said coil spring mounted on said pin causes said plastic handle to restore to a non-cutting position after downward depression of said plastic handle for cutting.

8. A hole puncher according to claim 7, further comprising:

a plastic guide post integral with said base and defining said guide hole, wherein said coil spring is mounted on said guide post.

9. A hole puncher according to claim 7, further comprising:

a second pin, a second guide hole which guides said second pin, and a second coil spring mounted on said second pin and spring loading said second pin into contact with said plastic handle.

10. A hole puncher according to claim 9, further comprising:

a second plastic guide post integral with said base and defining said second guide hole, wherein said second coil spring is mounted on said second plastic guide post.

11. A hole puncher according to claim 9, further comprising:

a third pin, a third guide hole which guides said third pin, and a third coil spring mounted on said third pin and spring loading said third pin into contact with said plastic handle.

12. A hole puncher according to claim 1, wherein:

said horizontal guide slot is formed with a slanted feed edge which guides insertion of said material.

13. A hole puncher according to claim 1, wherein:

said one piece of plastic is a plastic chosen from one of polypropylene and nylon.

14. A hole puncher according to claim 1, wherein:

said one piece of plastic is a translucent plastic.

15. A hole puncher comprising:

a) a plastic base having formed therein a horizontal guide slot and a guide hole which guides a pin vertically over said guide slot;

b) a plastic handle for depressing said pin in said guide hole so as to cut through material placed in said guide slot; and c) a plastic connector strip between said plastic base and said plastic handle;

d) first, second, and third plastic hinges, said first plastic hinge coupling said plastic connector strip to said plastic base, and said second plastic hinge coupling said plastic connector strip to said plastic handle, said first and second plastic hinges being flexible and foldable, and said plastic base, said plastic handle, and said plastic connector strip being relatively rigid relative to said first and second plastic hinges;

e) a plastic receptacle means disposed under said plastic base for collecting pieces of said material cut through by said pin, wherein said plastic receptacle means is coupled to said plastic base by said third hinge; and f) a plastic strap integrally formed with said plastic handle and inserted into a hole formed in said plastic base, wherein said plastic base, said plastic handle, said plastic connector strip, said first, second and third plastic hinges, and said plastic receptacle means are formed of one piece of plastic, and said hole puncher is formed by folding said one piece of plastic at said first, second, and third hinges, and said plastic locking strap maintains said hole puncher in a folded arrangement.

16. A hole puncher according to claim 15, further comprising:

a plastic guide post integral with said base and defining said guide hole, said pin which is guided by said guide hole, and a coil spring mounted on said pin and on said plastic guide post and spring loading said pin into contact with said plastic handle, wherein said coil spring mounted on said pin and said plastic guide post causes said plastic handle to restore to a non-cutting position after downward depression of said plastic handle for cutting.

17. A hole puncher according to claim 16, further comprising:

a second pin, a second plastic guide post integral with said base and defining a second guide hole which guides said second pin, and a second coil spring mounted on said second pin and said second plastic guide post and spring loading said second pin into contact with said plastic handle.

18. A hole puncher according to claim 17, wherein:

said horizontal guide slot is formed with a slanted feed edge which guides insertion of said material.

19. A hole puncher according to claim 15, wherein:

said one piece of plastic is a plastic chosen from one of polypropylene and nylon.

* * * * *